US011248802B2

(12) United States Patent
Duffy et al.

(10) Patent No.: US 11,248,802 B2
(45) Date of Patent: Feb. 15, 2022

(54) ORIFICE HOLDER

(71) Applicant: WHIRLPOOL CORPORATION, Benton Harbor, MI (US)

(72) Inventors: Patrick J. Duffy, St. Joseph, MI (US); Ken E. Johnson, Owasso, OK (US); Victor H. Manrique, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 102 days.

(21) Appl. No.: 16/656,767

(22) Filed: Oct. 18, 2019

(65) Prior Publication Data

US 2021/0116130 A1 Apr. 22, 2021

(51) Int. Cl.
*F24C 3/08* (2006.01)
*F23D 14/06* (2006.01)

(52) U.S. Cl.
CPC ..... *F24C 3/08* (2013.01); *F23D 14/06* (2013.01); *F23D 2203/00* (2013.01)

(58) Field of Classification Search
CPC ..... F23C 3/02; F23C 3/085; F23C 3/082
USPC ..... 126/39 E, 39 R, 39 B; 73/861.66
See application file for complete search history.

(56) References Cited

U.S. PATENT DOCUMENTS

| | | | | |
|---|---|---|---|---|
| 6,030,207 | A | 2/2000 | Saleri | |
| 6,889,685 | B2 | 5/2005 | Dane | |
| 7,291,009 | B2 | 11/2007 | Kamal et al. | |
| 7,661,954 | B2 | 2/2010 | Harneit | |
| 7,878,800 | B2 | 2/2011 | Bettinzoli | |
| 8,746,229 | B2 | 6/2014 | Lacche | |
| 8,747,108 | B2 * | 6/2014 | Lona Santoyo | F23D 14/06 431/284 |
| 10,190,778 | B2 | 1/2019 | Emiliani | |
| 2009/0047611 | A1 | 2/2009 | Armanni | |
| 2010/0319677 | A1 | 12/2010 | Lacche | |

FOREIGN PATENT DOCUMENTS

| | | | |
|---|---|---|---|
| EP | 2884176 | B1 | 11/2018 |
| EP | 3306192 | B1 | 4/2020 |
| WO | 2016142872 | A1 | 9/2016 |

* cited by examiner

*Primary Examiner* — Vivek K Shirsat
(74) *Attorney, Agent, or Firm* — Price Heneveld LLP

(57) ABSTRACT

An orifice holder includes a body that defines an inner chamber and inner wall portions. The inner wall portions each have a first width that is defined relative to the upper portion of the body. A first cup extends outwardly from the inner wall portions. A second cup extends outwardly from the inner wall portions and interconnects with the first cup through the inner wall portions. An airflow path is defined to the inner chamber from the first and second cups.

20 Claims, 14 Drawing Sheets

ORIFICE HOLDER

BACKGROUND OF THE DISCLOSURE

The present disclosure generally relates to a gas burner assembly, and more specifically, to an orifice holder for a gas burner assembly.

SUMMARY OF THE DISCLOSURE

According to one aspect of the present disclosure, a gas burner assembly for a cooktop includes a spreader that defines a top and an underside. The spreader includes a stem that extends from the underside to a depth and has a first diameter. The stem defines an opening to the top of the spreader. An orifice holder has a body that defines inner wall portions and receives a portion of the stem. A body defines at least one cup outwardly extending from the inner wall portions. The at least one cup is in fluid communication with the opening in the stem between the inner wall portions.

According to another aspect of the present disclosure, a cooktop includes a surface and a spreader. The spreader defines a top and an underside. A stem extends away from the underside and defines an opening. An orifice holder includes a body that defines inner wall portions, a first cup and a second cup. The first cup and the second cup extend outwardly from the inner wall portions. An airflow path to the first and second cups defines between the surface and the underside of the spreader.

According to yet another aspect of the present disclosure, an orifice holder includes a body that defines an inner chamber and inner wall portions, each having a first width relative to an upper portion of the body. A first cup extends outwardly from the inner wall portions. A second cup extends outwardly from the inner wall portions and interconnects with the first cup through the inner wall portions. An airflow path is defined to the inner chamber from the first and second cups.

These and other features, advantages, and objects of the present disclosure will be further understood and appreciated by those skilled in the art by reference to the following specification, claims, and appended drawings.

Figure 1:
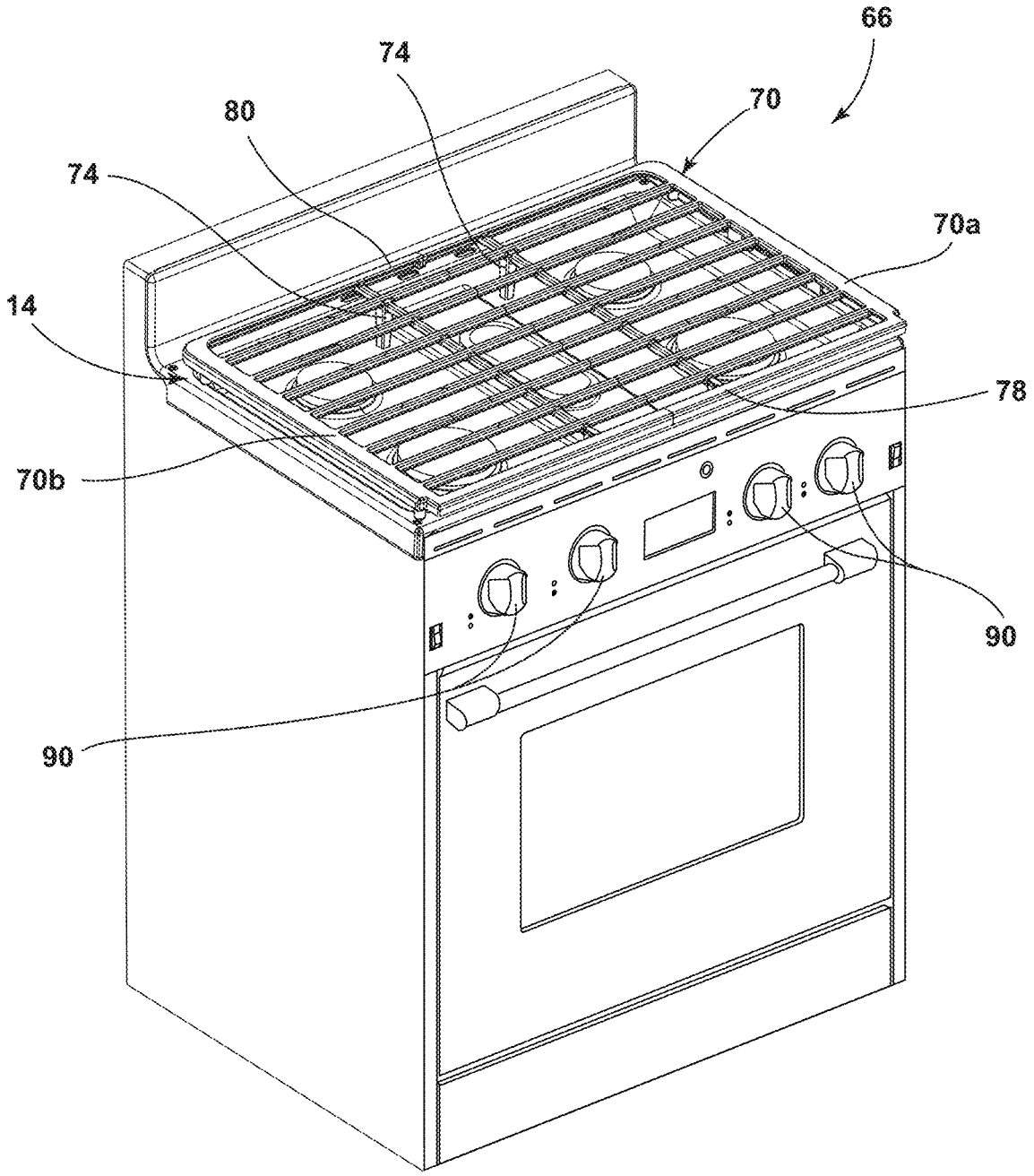
FIG. 1 is a top perspective view of an appliance according to at least one aspect of the disclosure.

The components in the figures are not necessarily to scale, emphasis instead being placed upon illustrating the principles described herein.

DETAILED DESCRIPTION

The present illustrated embodiments reside primarily in combinations of apparatus components related to an orifice holder. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-12, reference numeral 10 generally designates a gas burner assembly for a cooktop 14. The gas burner assembly 10 includes a spreader 18 that defines a top 22 and an underside 26 and includes a stem 30. The stem 30 extends from the underside 26 to a depth 34 and has a first diameter 38. The stem 30 defines an opening 42 to the top 22 of the spreader 18. An orifice holder 46 has a body 50 that defines inner wall portions 54 that receives a portion of the stem 30 therebetween. The body further defines at least one cup 52 that includes a first cup 58 and a second cup 62 outwardly extending from the inner wall portions 54. The first and second cups 58, 62 are in fluid communication with the opening 42 in the stem 30 between the inner wall portions 54.

Figure 2:
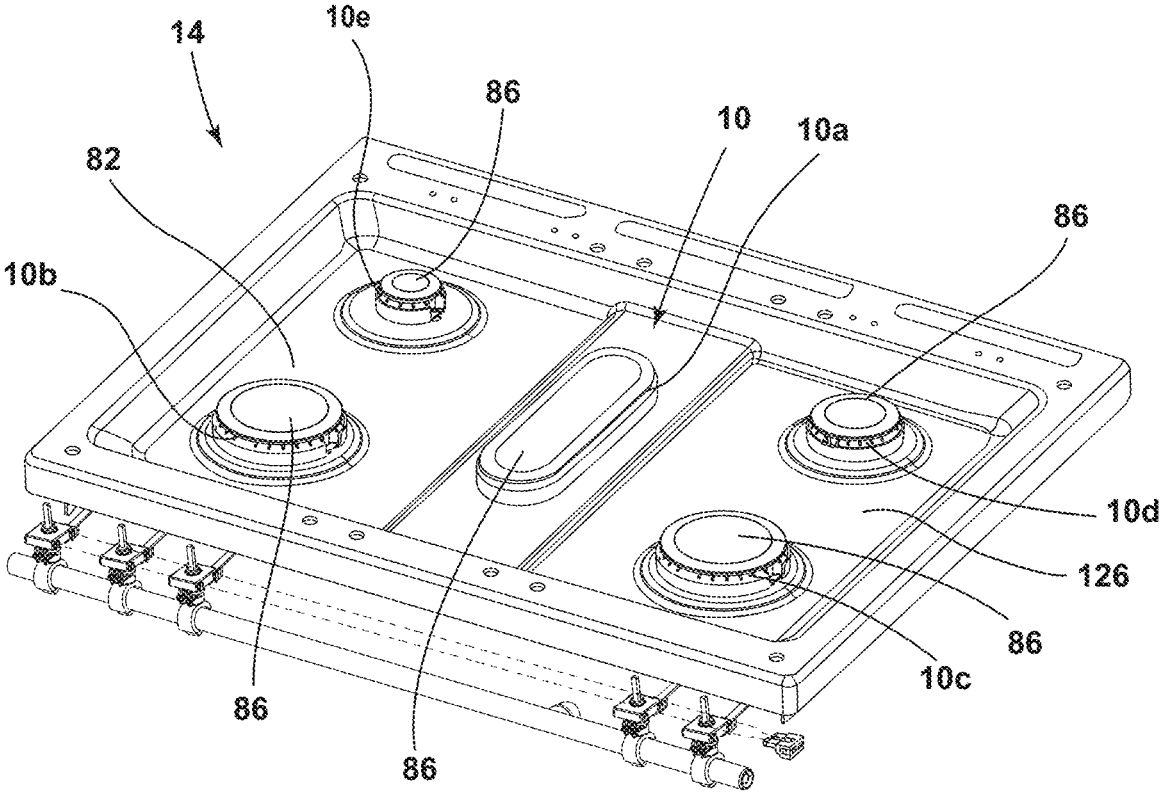
FIG. 2 is a top perspective view of a cooktop of the appliance of FIG. 1 according to at least one aspect of the disclosure.
Figure 3:
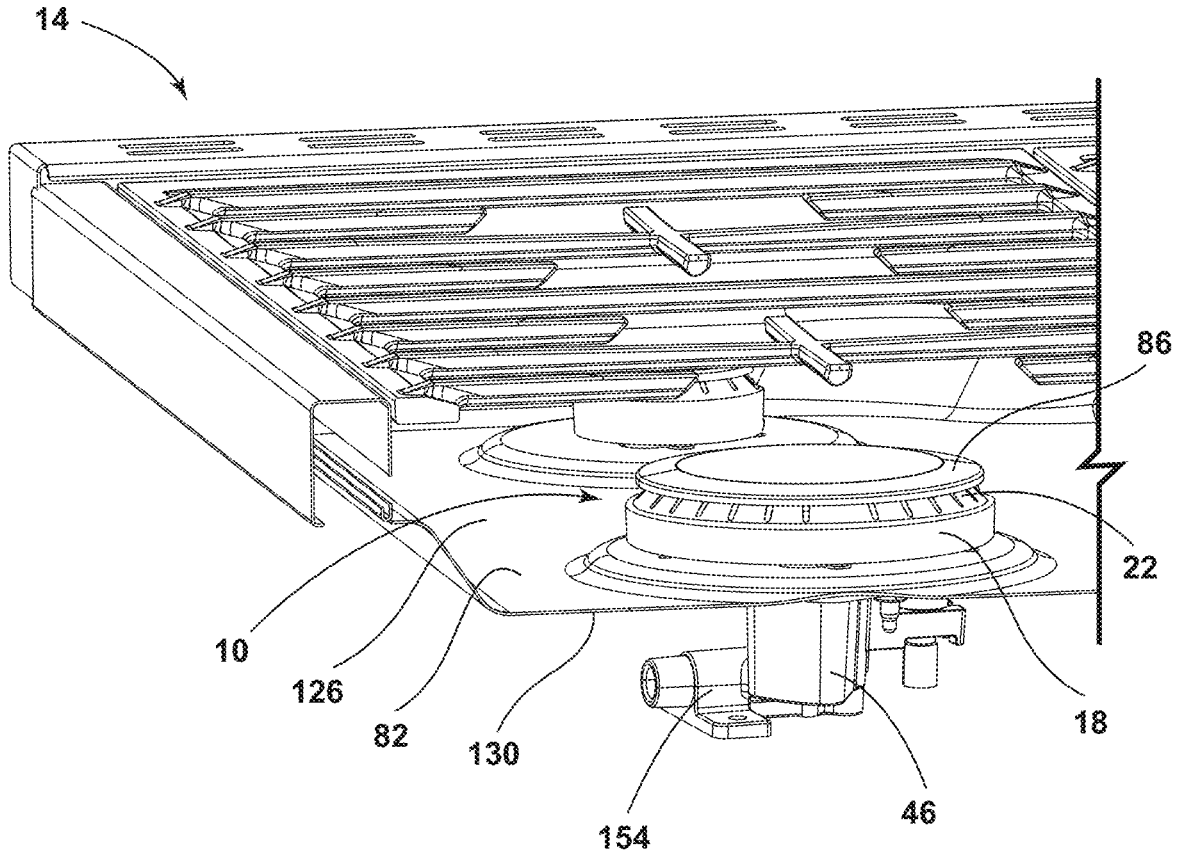
FIG. 3 is a partial cross-sectional side perspective view of a gas burner assembly and the cooktop of FIG. 2 according to at least one aspect of the disclosure.

Referring now to FIGS. 1-3, an appliance 66 includes a cooktop 14, typically, positioned below grates 70 for supporting cooking utensils, such as pots and pans on the grates 70. It is contemplated that the cooktop 14 may be disposed on a single oven, a double oven, or a combination thereof. It is further contemplated that the cooktop 14 may be disposed on another appliance and/or as a stand-alone appliance on a countertop. The grates 70 are shown as a first grate 70*a* and a second grate 70*b* each of which is raised above the cooktop 14 via legs 74. The grates 70 may be hingedly coupled to the cooktop 14, such that a front portion 78 of the grates 70 may be lifted relative to the cooktop 14 while a rear portion 80 may remain coupled to the cooktop 14. Alternatively, the grates 70 may be positioned upon the cooktop 14 so that the grates 70 may be fully removed from the cooktop 14 without additional detachment.

As illustrated in FIGS. 2 and 3, the cooktop 14 includes a plurality of gas burner assemblies 10, which may include individual gas burner assemblies 10*a*-10*e* positioned along a surface 82 of the cooktop 14. For example, a central gas burner assembly 10*a* may be generally elongated to form an oval shape with functionality with additional components such as a griddle. Additionally or alternatively, the gas burner assemblies 10 may have a larger configuration for use as, for example, a power burner. For instance, the two front gas burner assemblies 10*b*, 10*c* may be generally larger than the two rear gas burner assemblies 10*d*,10*e*. Due to the varying shapes of the gas burner assemblies 10, the gas burner assemblies 10 may require additional coupling between the spreader 18 and the orifice holder 46 to maintain the orientation of the gas burner assembly 10 relative to the surface 82 of the cooktop 14. It is generally contemplated that the orifice holder 46, as described herein, may be used with a variety of gas burner assemblies 10 including, but not limited to, the griddle configuration, small burner configuration, and/or larger burner configuration.

Each gas burner assembly 10 includes a burner cap 86 positioned relative to the top 22 of the spreader 18. The burner cap 86 is typically removably coupled to the spreader 18 and may be positioned on the spreader 18 such that the burner cap 86 rests upon the spreader 18. When the burner cap 86 is positioned on the spreader 18, the gas burner assembly 10 may be activated via a knob 90 on the appliance 66 (FIG. 1). Typically, the gas burner assembly 10 may be limited from activation if the burner cap 86 is unattached or improperly aligned with the spreader 18. Because the burner cap 86 is positioned on the top 22 of the spreader 18, the air may be more evenly distributed to the apertures 110. Additionally, an electrical arc is defined between an ignitor 122 and the burner cap 86. Upon formation of the electrical arc, the ignitor 122 may engage the burner cap 86 to ignite the fuel supply. Accordingly, the air used for combination with the fuel supply may be drawn from below the surface 82 of the cooktop 14 and/or between the spreader 18 and the orifice holder 46, as discussed in more detail below.

Referring now to FIGS. 4-7, the spreader 18 may include supports 146 (FIG. 6) defined by the underside 26 of the spreader 18, which may provide structural reinforcement for supporting the spreader 18 and the burner cap 86 when coupled with the orifice holder 46. The stem 30 of the spreader 18 is centrally positioned with the supports 146 surrounding the stem 30. In addition, the top 22 of the spreader 18 includes a structural definition that may direct a fluidic path 94 from the orifice holder 46. The fluidic path 94 may be directed within and around a central portion 98 and an outer perimeter 102 of the top 22 of the spreader 18, such that there may be an even distribution of the fluidic path 94 along the top 22. The fluidic path 94 is generally comprised of a combination of air and gas to provide fuel resulting in flames that may extend through apertures 110 defined by a burner crown 114 that is disposed around the outer perimeter 102. The even distribution of the fluidic path 94 helps to maintain the flames at a selected level throughout the use of the gas burner assembly 10. The outer perimeter 102 of the spreader 18 may further define a recess 118 configured to receive the igniter 122, which may be, by way of example, a spark-ignition electrode. It is generally contemplated that the recess 118 may be positioned along the spreader 18 to accommodate various positions and constructions of the gas burner 10. It is also contemplated that the size of the recess 118 may vary depending on the size of the gas burner 10. The igniter 122 provides the ignition in order to translate the fluidic path 94 into the flames that may extend through the apertures 110 of the burner crown 114.

The top 22 of the spreader 18 is typically exposed above an outer portion 126 of the surface 82, while the orifice holder 46 may be positioned below the surface 82 proximate an inner portion 130 of the surface 82. Alternatively, the spreader 18 may be divided by the outer portion 126 of the surface 82, such that the underside 26 of the spreader 18 is positioned below the outer portion 126 of the surface 82. In addition, the burner crown 114 of the spreader 18 is typically positioned above the surface 82 to ensure proper flame distribution.

Figure 4:
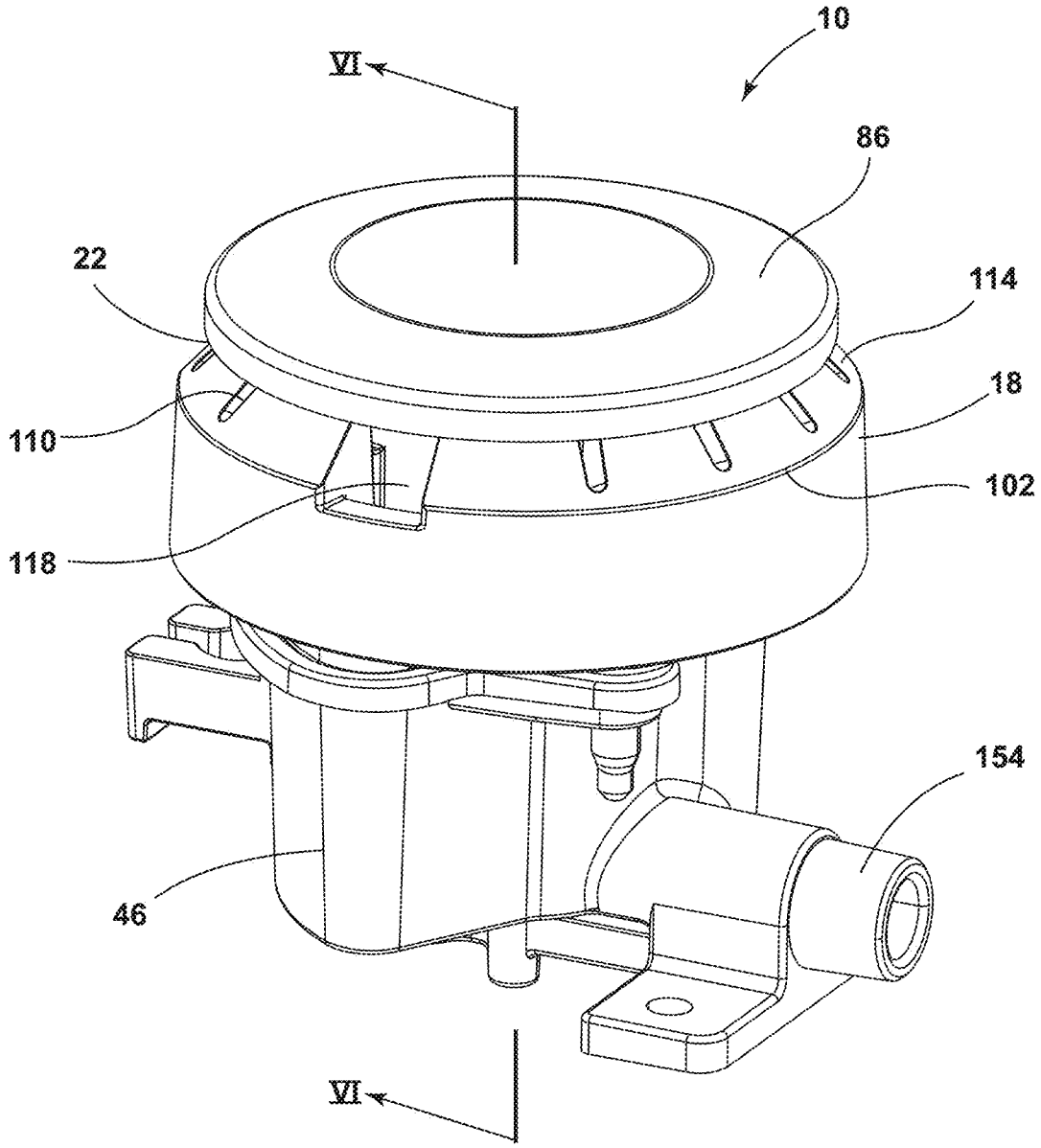
FIG. 4 is a side perspective view of the gas burner assembly of FIG. 3.
Figure 5:
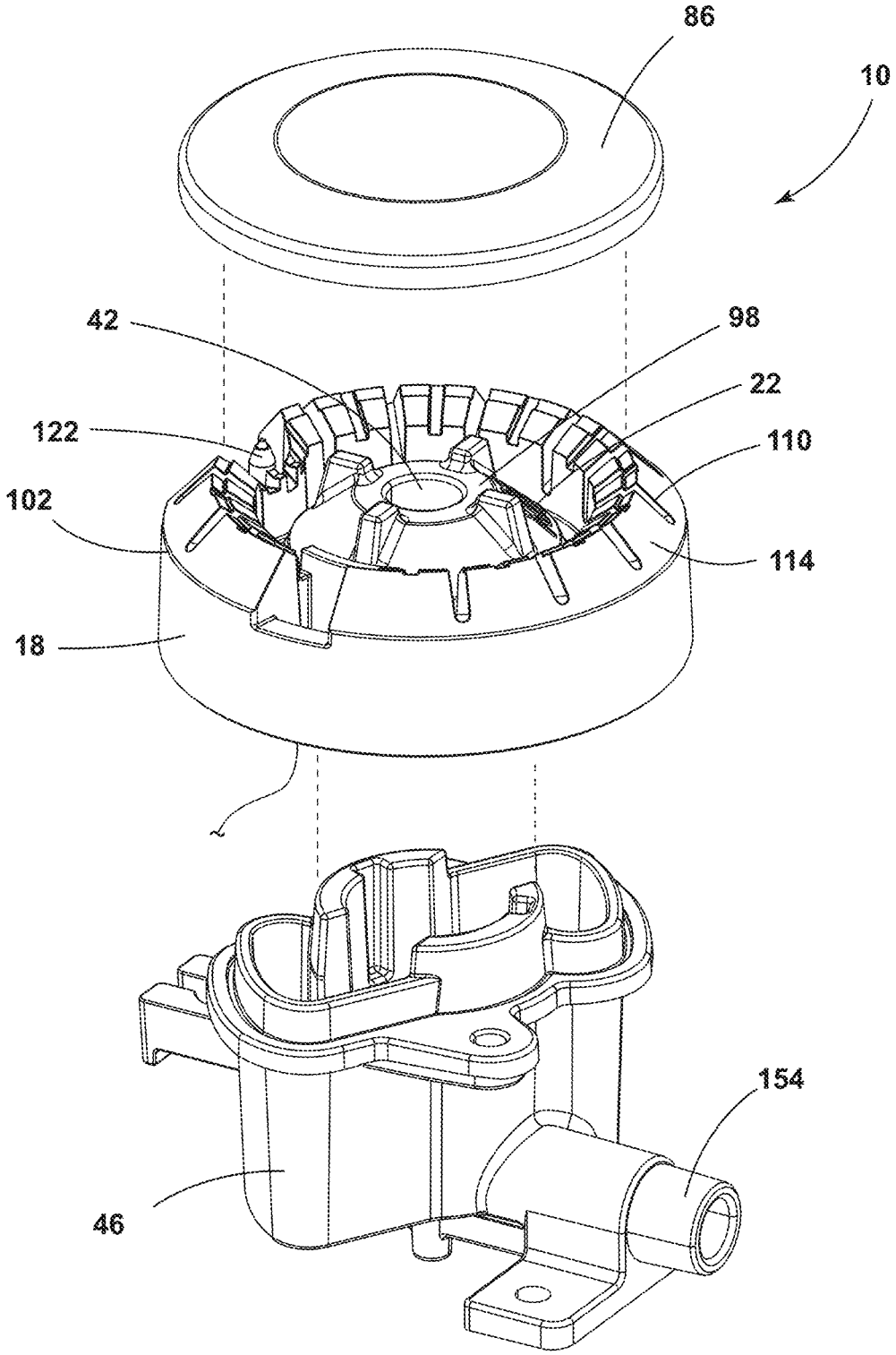
FIG. 5 is an exploded side perspective view of the gas burner assembly of FIG. 4.
Figure 6:
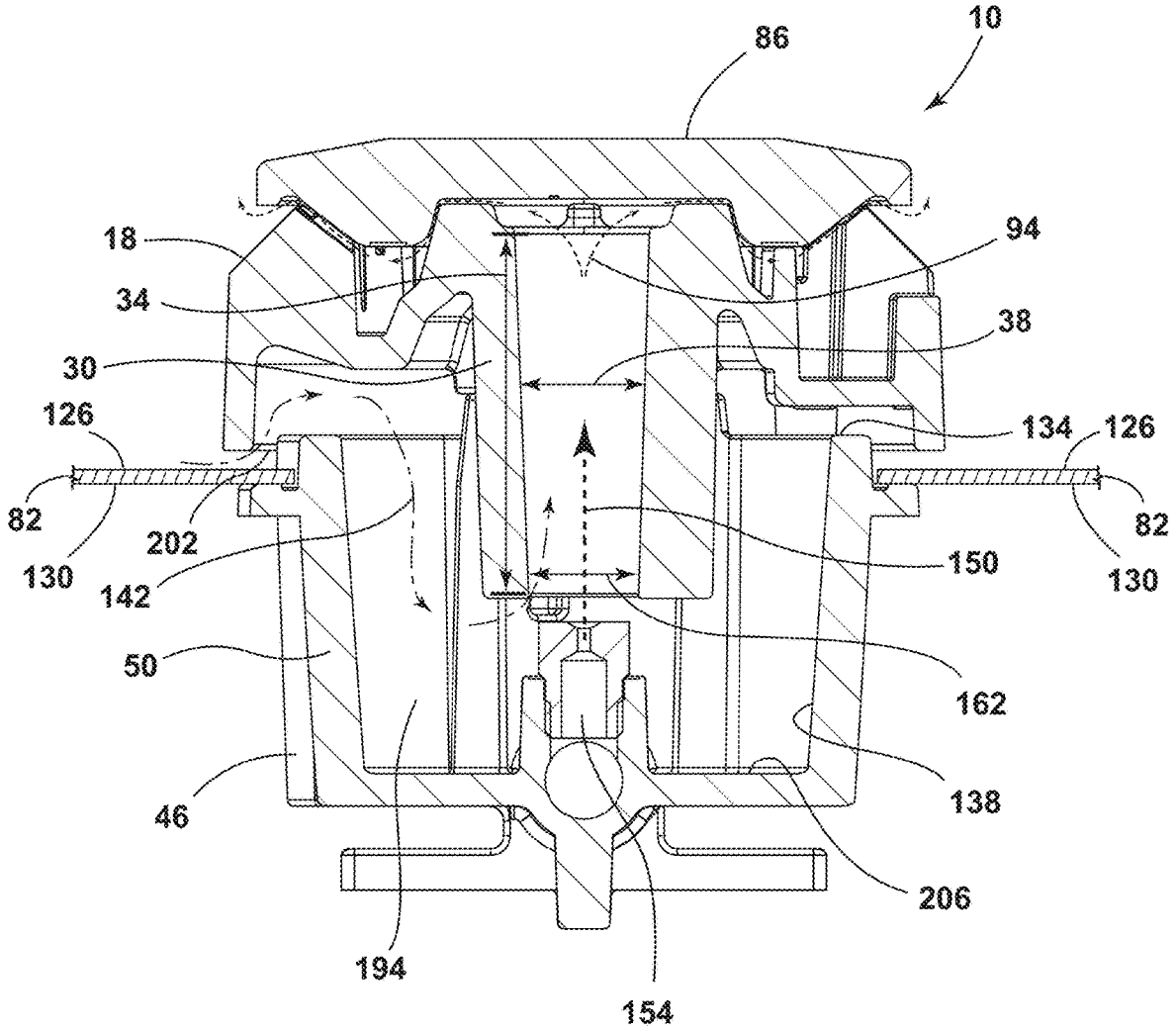
FIG. 6 is a cross-sectional view of the gas burner assembly of FIG. 4.
Figure 7:
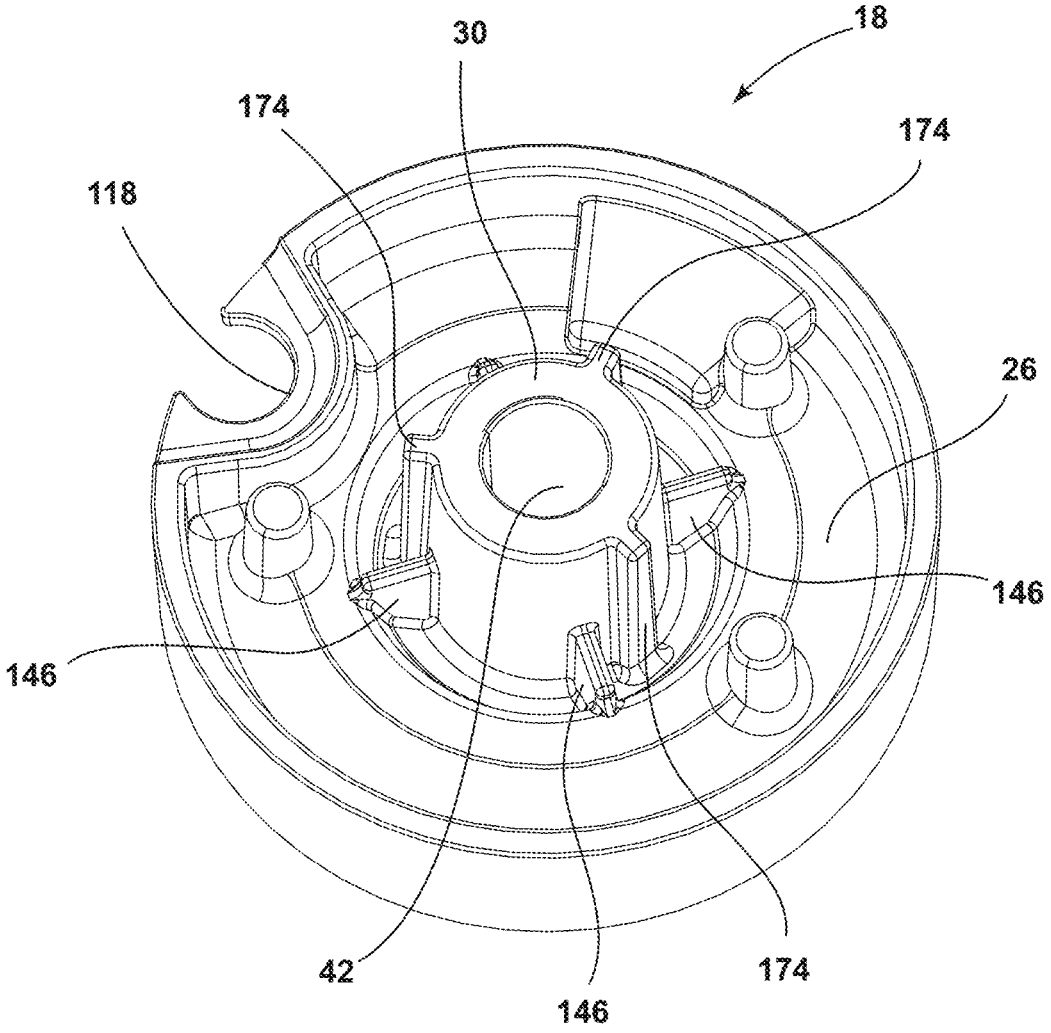
FIG. 7 is a bottom perspective view of a spreader of the gas burner assembly of FIG. 3.

As illustrated in FIGS. 4 and 5, the orifice holder 46 is coupled to the underside 26 of the spreader 18 at the supports 146 above the surface 82 of the cooktop 14 and may be rigidly affixed to the inner portion 130 of the surface 82 via fasteners. The fasteners may be screws, bolts, rivets, or any other fastener generally known in the art. Additionally, the orifice holder 46 is configured to receive the stem 30 of the spreader 18, as discussed in more detail below. As shown in FIG. 6, the body 50 of the orifice holder 46 is further defined by an upper portion 134 and a lower portion 138, typically such that the upper portion 134 is in fluid communication with the spreader 18. Stated differently, an airflow path 142 is directed into the body 50 of the orifice holder 46 through the upper portion 134 and down towards the lower portion 138 of the body 50. Generally, such a gas burner assembly 10 may be described as being an air-from-top gas burner assembly 10, since the airflow path 142 is drawn in from the upper portion 134 of the orifice holder 46 from above the outer portion 126 of the surface 82 rather than from below the inner portion 130 of the surface 82.

Moreover, the stem 30 defines the opening 42, which helps to draw the airflow path 142 from the orifice holder 46 to combine with a fuel path 150 to form the fluidic path 94. While the airflow path 142 is provided by the orifice holder 46, the fuel path 150 may be provided from a gas injection port 154 positioned below the gas burner assembly 10 proximate the orifice holder 46. Accordingly, the spreader 18 and the orifice holder 46 are in fluid communication. The fluidic path 94 may then be ignited by the igniter 122 to form flames. In order to direct the fluidic path 94, the stem 30 of the spreader 18 outwardly extends from the underside 26 of the spreader 18 and is configured to fit within the orifice holder 46.

The generally tapered configuration of the stem 30 may fit within the generally tapered inner wall portions 54 of the orifice holder 46 to support the underside 26 of the spreader 18 in a position above the orifice holder 46. Stated differently, the first diameter 38 and a second diameter 162 may generally correspond and, respectively, fit within a first width 166 and a second width 170 of the inner wall portions 54. Typically, this tapered configuration of the stem 30 may be used with an air-from-the-bottom burner assembly; however, in the present disclosure the tapered stem 30 may also be used with the air-from-top gas burner assembly 10. In addition, the generally tapered configuration may also help to further direct the airflow path 142, the fuel path 150, and ultimately the fluidic path 94. By way of example, not limitation, the first diameter 38 may be defined as proximate the underside 26 of the spreader 18 and is generally wider than a second diameter 162 of the stem 30. Generally, the second diameter 162 may be defined proximate the lower portion 138 of the orifice holder 46. As mentioned above, the tapered construction of the stem 30 may provide for directional control of the fluidic path 94 by concentrating the airflow path 142 and the fuel path 150 in the narrower portion of the stem 30 to facilitate the mixture of air and gas to form the fluidic path 94. As illustrated, the first diameter 38 is generally wider than the second diameter 162, which allows the fluidic path 94 to flow freely upward through the stem 30 and outward from the opening 42 towards the burner crown 114 and the igniter 122 to result in flames. However, it is also contemplated that the first diameter 38 is equal to or more narrow than the second diameter 162. In addition, the stem 30 may include projections 174 that fit within corresponding grooves 178 defined by the inner wall portions 54 of the orifice holder 46. The projections 174 may engage with the grooves 178 in order to provide stability between the spreader 18 and the orifice holder 46 such that, depending on the configuration, there may be minimal movement during operation or cleaning of the gas burner assembly 10 relative to the surface 82 of the cooktop 14. It is generally contemplated that the number, size, and position of the grooves 178 may vary depending on the configuration of the orifice holder 46. In addition, the grooves 178 may provide a user with a poka-yoke design, such that upon removal of the spreader 18 from the orifice holder 46 the user will be able to replace the spreader 18 with minimal difficulty. Stated differently, the grooves 178 may mistake-proof the assembly of the spreader 18 with the orifice holder 46.

Referring now to FIGS. 6 and 8-10, the inner wall portions 54 may be tapered similarly to the stem 30 in that a first width 166 of the inner wall portions 54 may be wider than a second width 170 of the inner wall portions 54. In addition, the first width 166 may be defined relative to the upper portion 134 of the body 50, while the second width 170 may be defined relative to the lower portion 138 of the body 50. The first width 166 may typically be wider than the second width 170; however, it is also contemplated that the second width 170 may be wider than the first width 166.

Furthermore, the first and second cups 58, 62 extend from the inner wall portions 54 and may be generally open to facilitate the fluid communication of air between the orifice holder 46 and the spreader 18. In addition, the body 50 of the orifice holder 46 defines the upper portion 134 and an inner chamber 194, which are in fluid communication with the first and second cups 58, 62. Accordingly, the airflow path 142 may enter the inner chamber 194 of the body 50 via a space 202 defined between the spreader 18 and the upper portion 134. Additionally or alternatively, the airflow path 142 may be defined between the spreader 18 and the surface 82, as the spreader 18 may be supported above the surface 82 by the orifice holder 46. Once air within the airflow path 142 is in the orifice holder 46, the first and second cups 58, 62 may help to facilitate the collection of air, ultimately directing the airflow path 142 within the inner chamber 194 and to the opening 42 of the spreader 18. Additionally, the inner wall portions 54 may brace the spreader 18 by the articulation with the stem 30, such that the spreader 18 is placed in a position above a bottom 206 of the body 50. Thus, the airflow path 142 may be drawn down to the bottom 206 of the body 50 and subsequently upward through the opening 42 in the stem 30. The airflow path 142 may then mix with the fuel provided from the gas injection port 154 to, ultimately, create the desired flame.

Figure 8:
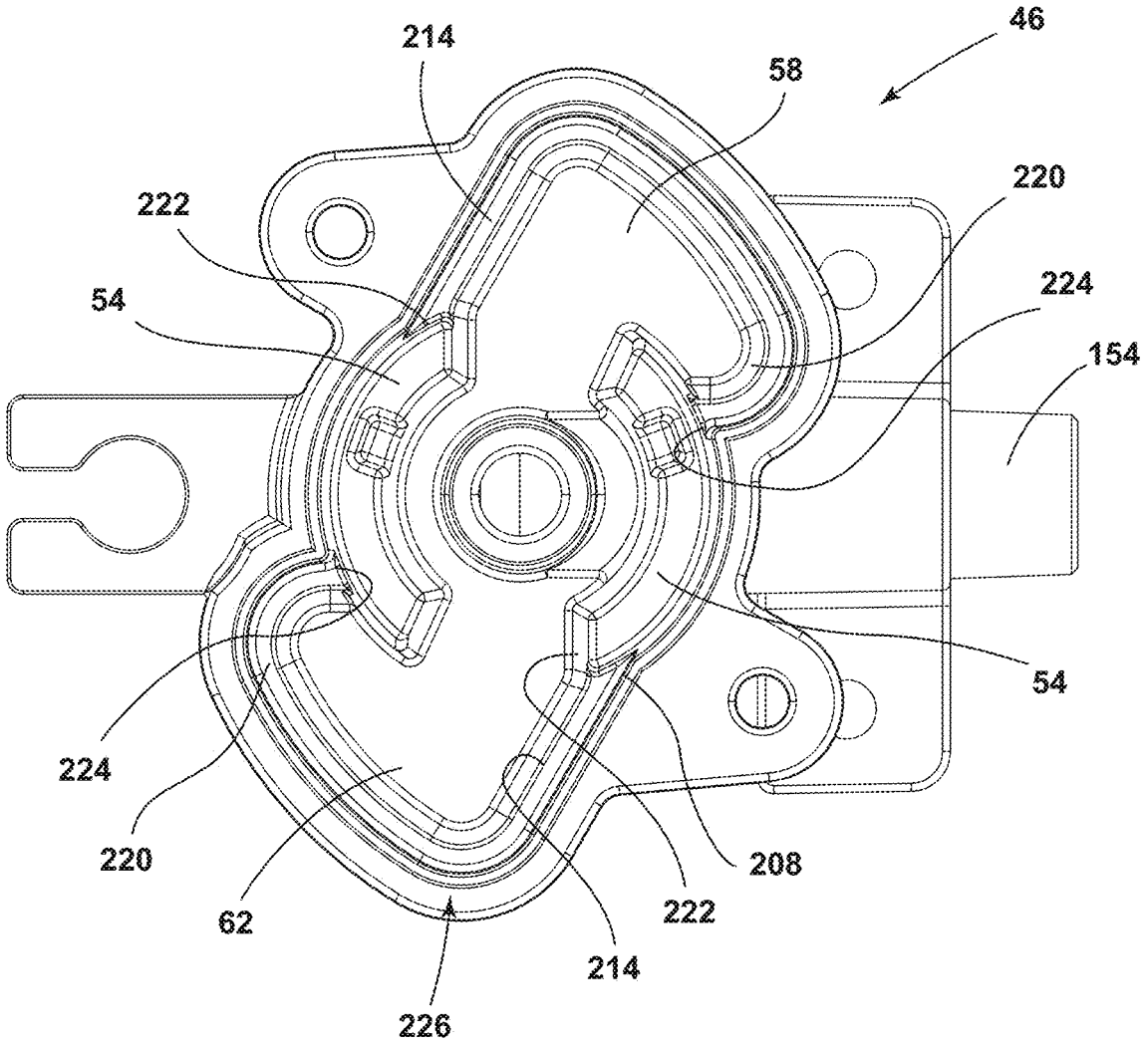
FIG. 8 is a top view of an orifice holder according to at least one aspect of the disclosure.
Figure 9:
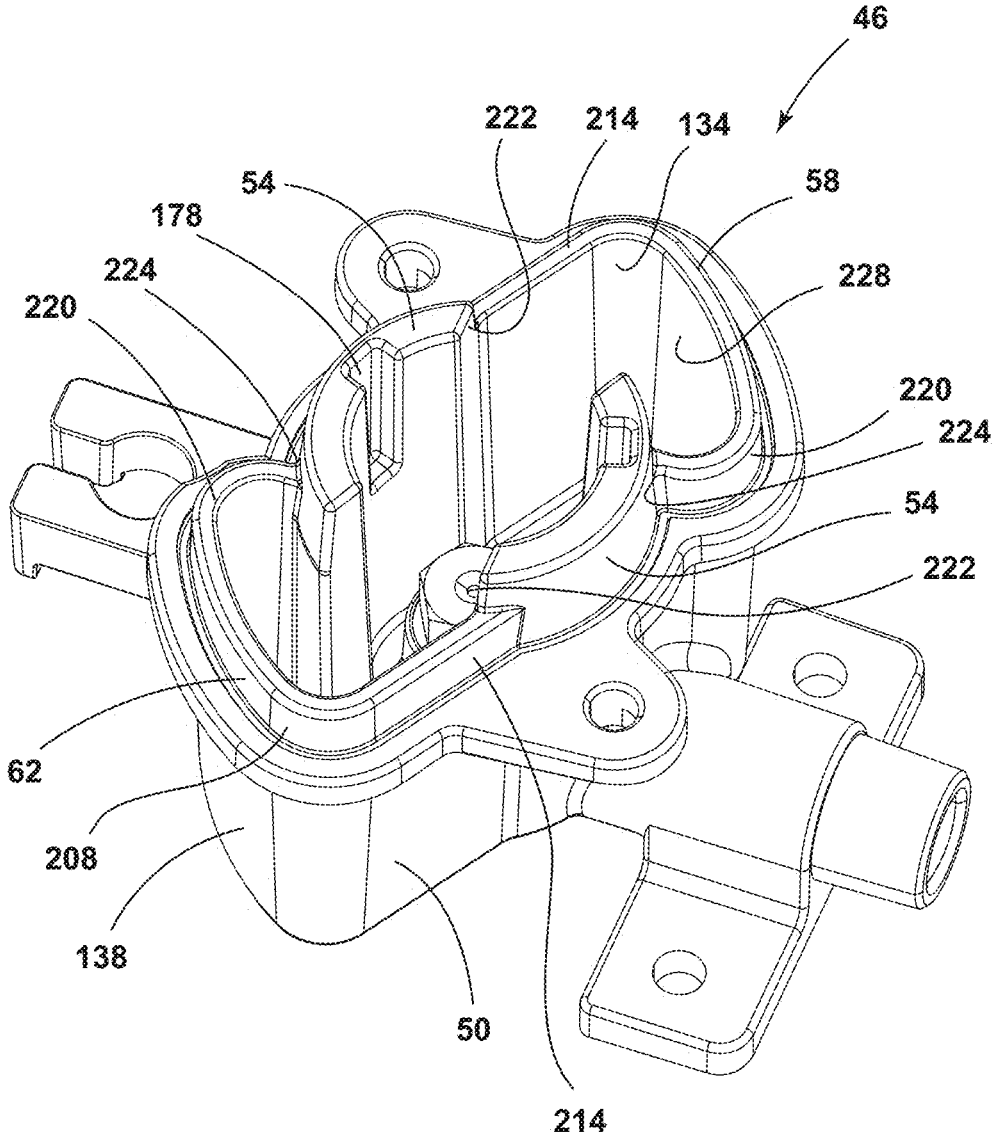
FIG. 9 is a side perspective view of the orifice holder of FIG. 8.
Figure 10:
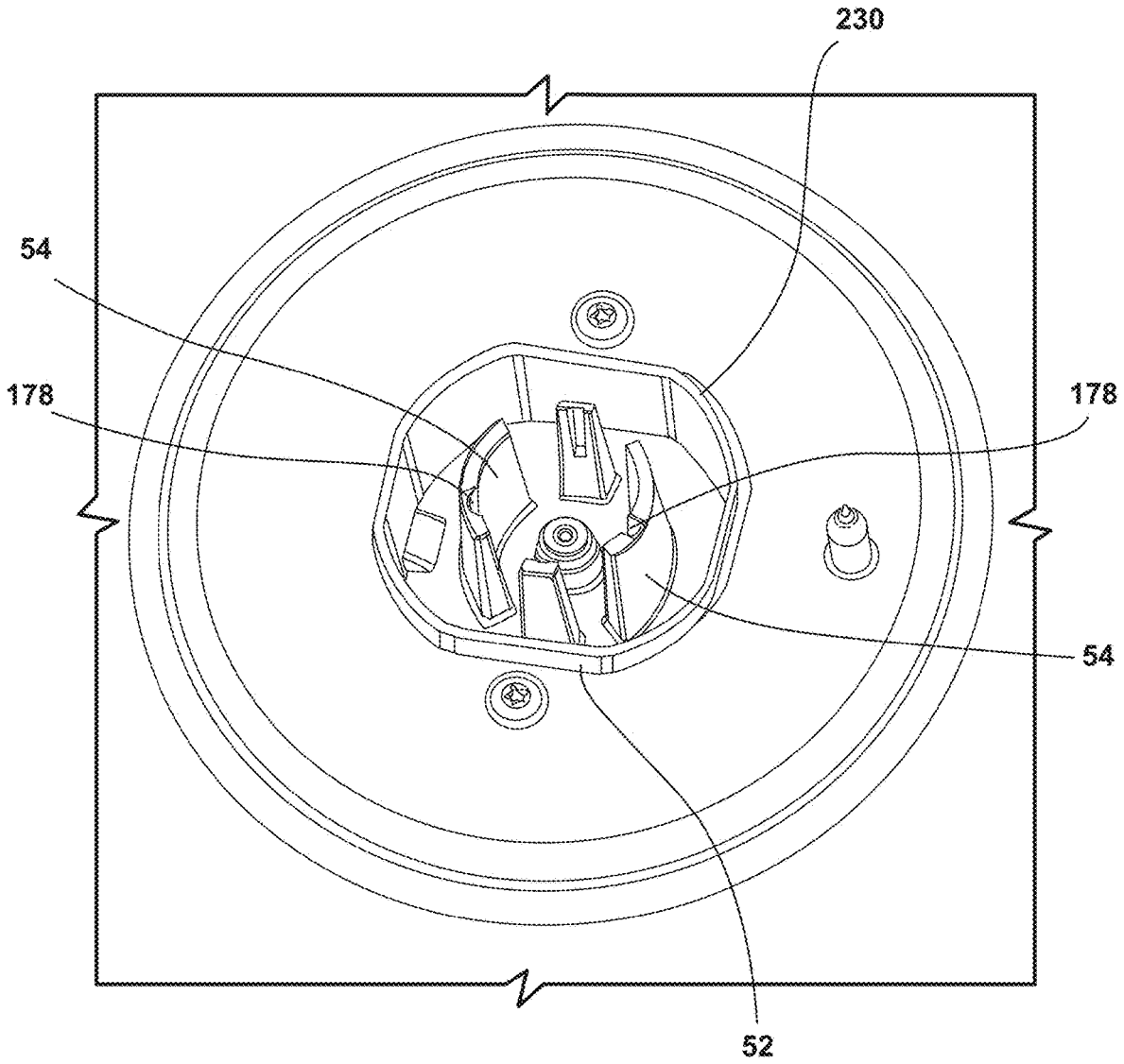
FIG. 10 is a top perspective view of an orifice holder according to at least one aspect of the disclosure.

To assist in the fluid communication between the orifice holder 46 and the spreader 18, the first and second cups 58, 62 are cavities defined by an extruded profile 208. As illustrated in FIGS. 8 and 9, the extruded profile 208 may include a linear portion 214 and a curved portion 220 that extend from an end 222 and a side 224 of each of the inner wall portions 54. To that end, the first and second cups 58, 62 may generally have a mutual Z-shape and/or triangular configuration, such that the orifice holder 46 generally has an oblong shape 226. This configuration may allow the airflow path 142 to move continuously in the inner chamber 194 through the first and second cups 58, 62 and upward to the spreader 18. The opposing triangular orientation of the first and second cups 58, 62 may create a bounce-back effect, such that the airflow path 142 may be in regular circulation while in the orifice holder 46. As a result, the inner surface 228 of the first and second cups 58, 62 may redirect the air to the inner wall portions 54. Stated differently, the oblong shape 226 of the first and second cups 58, 62 may also help to direct the airflow path 142 to the inner wall portions 54 to be drawn into the opening 42 of the stem 30. Additionally or alternatively, the at least one cup 52 may be a single cup 230 surrounding the inner wall portions 54 that similarly helps direct the airflow path 142. As the airflow path 142 enters the stem 30, the air may mix with the fuel to form the fluidic path 94 that may travel from the stem 30 to the spreader 18. It is also contemplated that the single cup may extend from a first side of the inner wall portions 54 with the airflow path 142 being directed from the single cup 230 to the inner wall portions 54. It is further contemplated that more than two cups may be used to direct the airflow path 142, such that a plurality of cups are used to direct the airflow path 142.

Figure 11:
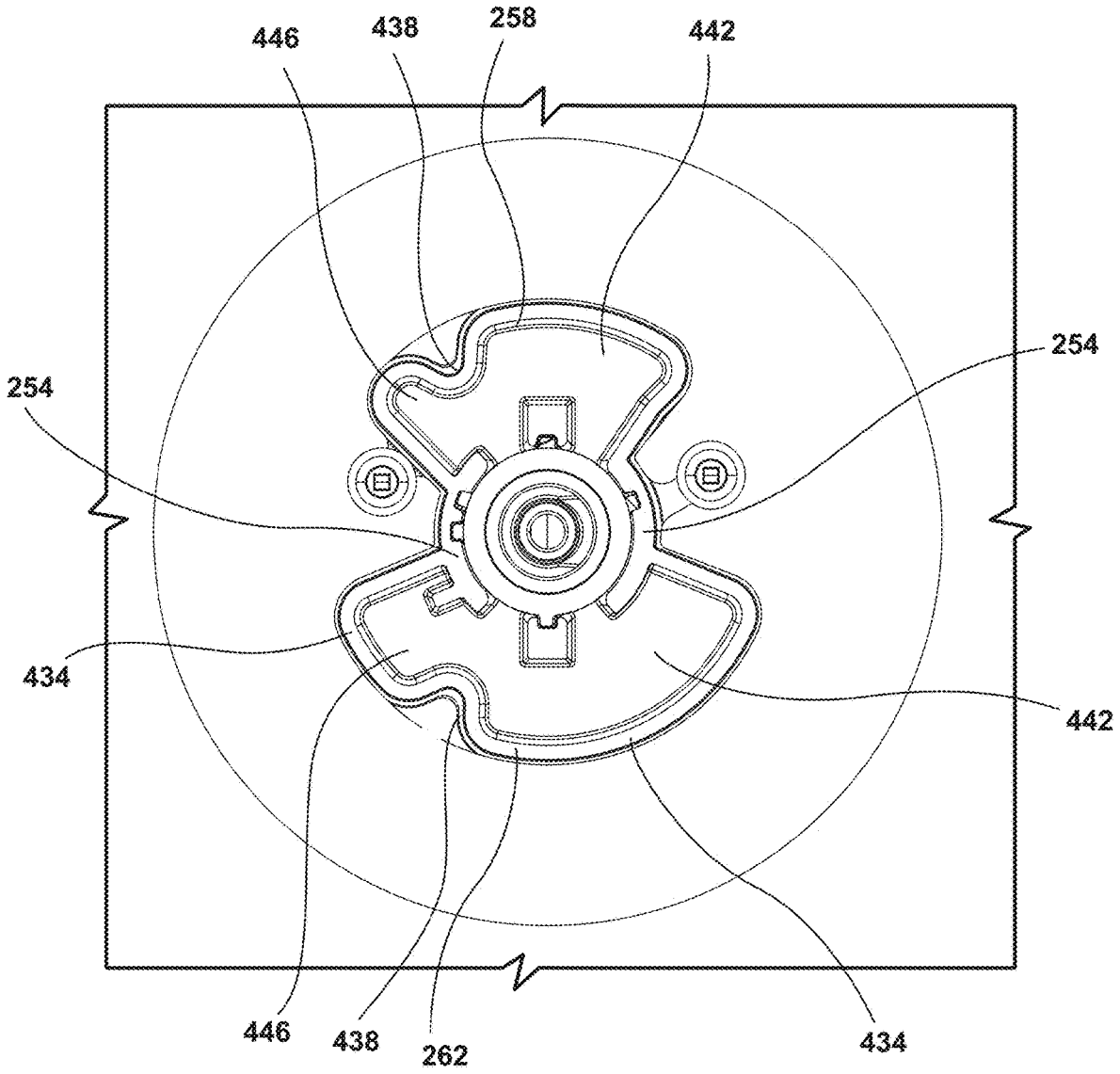
FIG. 11 is a top view of an orifice holder according to at least another aspect of the disclosure.
Figure 12:
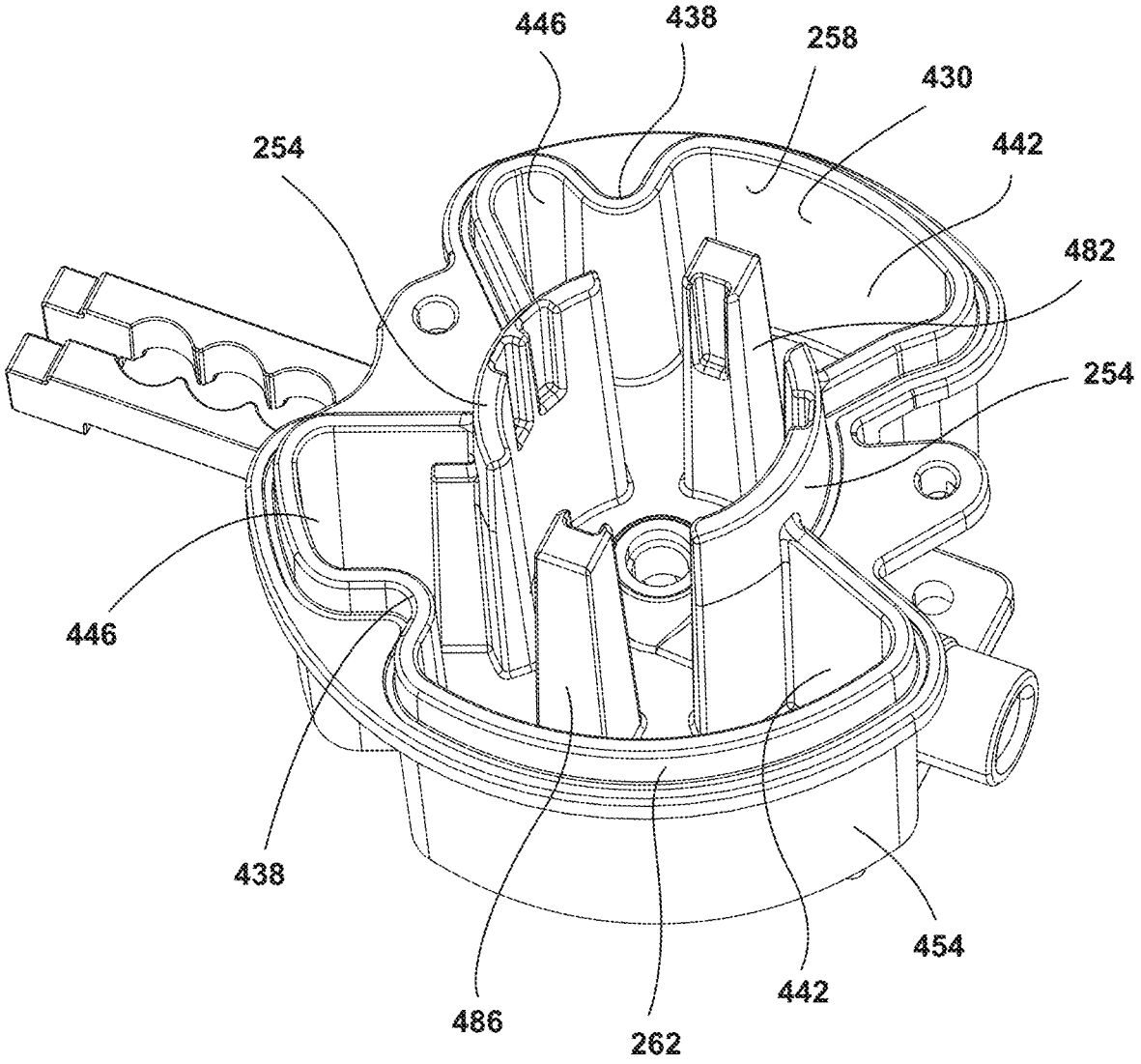
FIG. 12 is a side perspective view of an orifice holder of FIG. 11.
Figure 13:
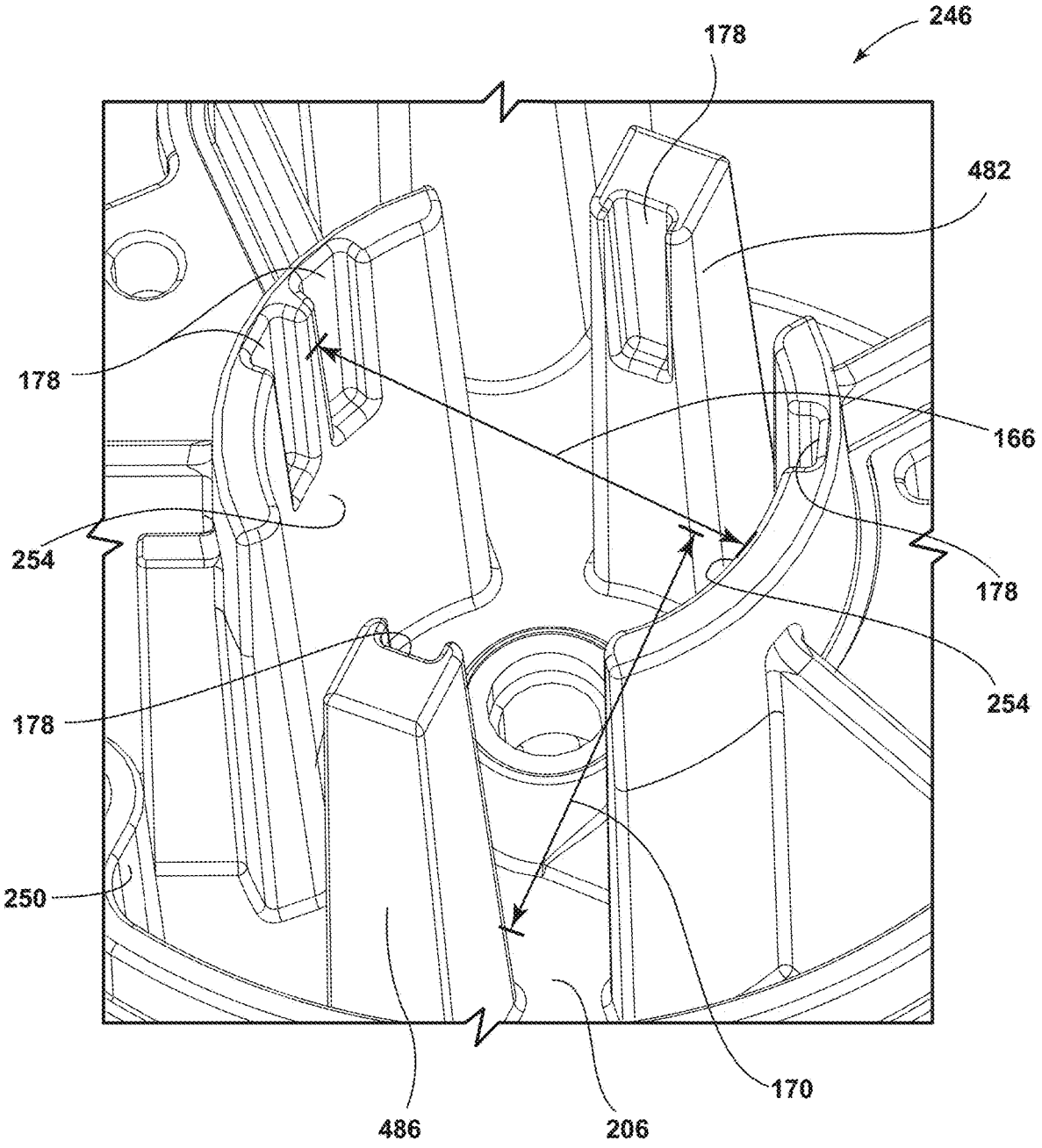
FIG. 13 is a partial top perspective view of inner wall portions of an orifice holder of the assembly.
Figure 14:
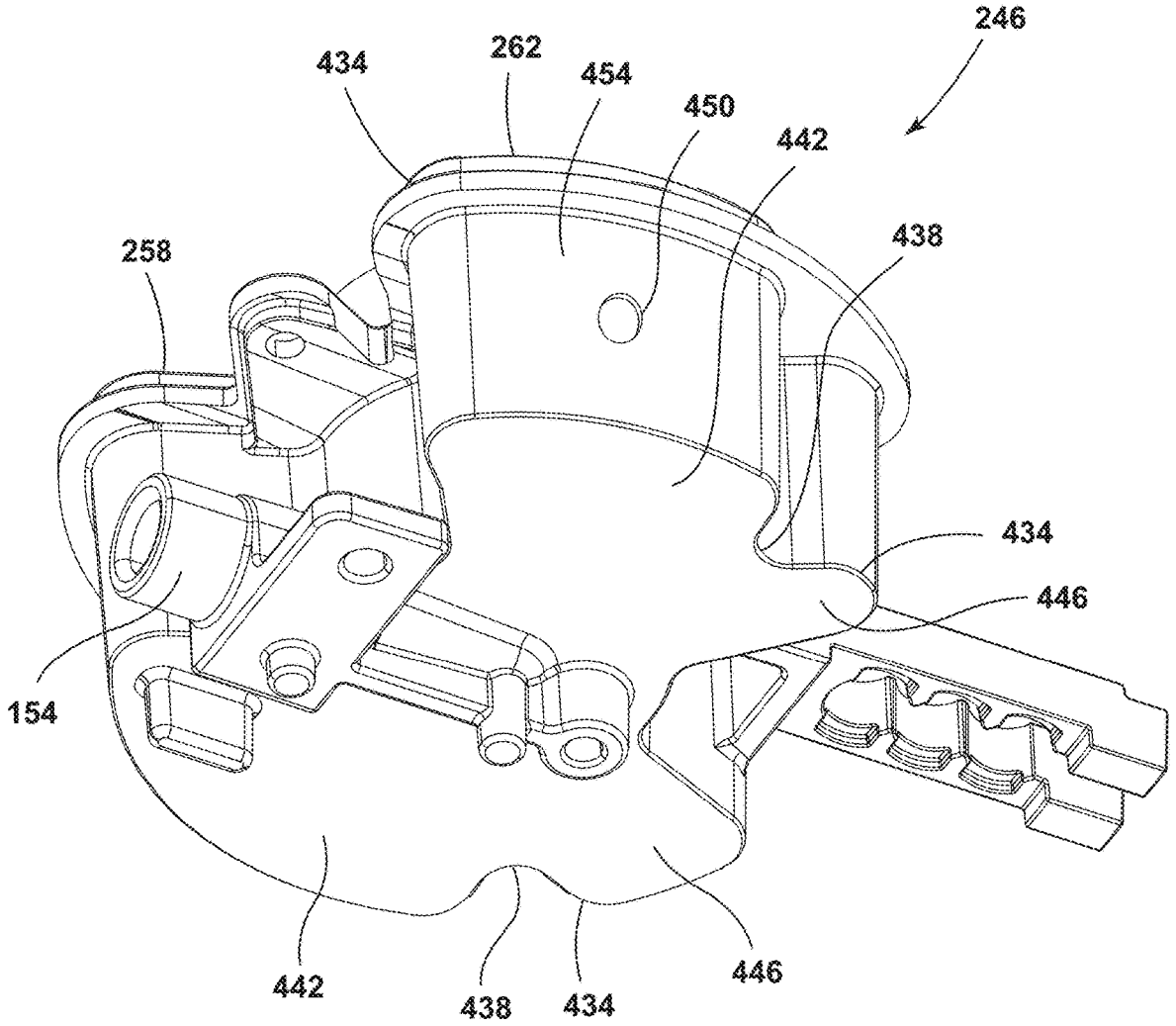
FIG. 14 is a bottom perspective view of an orifice holder of FIG. 12.

Referring now to FIGS. 11-13 show a further example of an orifice holder 246 that is generally similar to the orifice holder 46 of FIGS. 1-10, except as discussed herein (with similar features indicated by similar numbers increased by 200), where in an alternative configuration the first and second cups 258, 262 may be generally wing-shaped and may be further defined by a peripheral rim 434 that defines an indentation 438. The indentation 438 may separate each of the first and second cups 258, 262 to define a first lobe 442 and a second lobe 446. Each of the first and second lobes 442, 446 may give further definition to the first and second cups 258, 262 and may provide additional airflow configurations. For example, an airflow path may enter through an upper portion, substantially similar to that shown in FIG. 6, of the body 250 into the first lobe 442 and may be directed around the indentation 438 to enter the second lobe 446. As each of the first and second lobes 442, 446 are also in fluid communication with the upper portion of the body 250, the airflow path may still be drawn in from the upper portion and down into the cavities of the first and second cups 258, 262. The generally curved shape of the first and second lobes 442, 446 may provide a more direct deflection of the airflow path towards the inner wall portions 254 and into the opening 42 of the stem. In addition, the further definition of the first and second cups 258, 262 expands the body 250 of the orifice holder 246, such that a larger volume of air may be received within the first and second cups 258,262. The increase in air intake by the first and second cups 258, 262 may result in larger and higher quality flames as a majority of the air used to form a fluidic path substantially similar to the fluidic path illustrated in FIG. 6, may be pulled from the orifice holder 246.

In addition, it is generally contemplated that holes 450 may be defined within sidewalls 454 of the body 250, as shown in FIG. 13. Accordingly, in addition to entering via the upper portion, the airflow path may enter through the holes 450 and into the body 250 of the orifice holder 246. It is generally contemplated that the airflow path that enters via the holes 450 may flow directly towards the inner wall portions 254. The addition of the holes 450 may provide increased air intake and, consequently, an increased amount of air in the fluidic path. This increase in air may create still larger flames and an increase in flame quality. Such a configuration generally combines the air-from-top gas burner assembly and an air-from-bottom gas burner assembly. For example, the airflow path may enter from both the space between the spreader and the upper portion, substantially similar to that shown in FIG. 6, of the orifice holder 246, as well as the holes 450 defined by the sidewalls 454 of the orifice holder 246. As depicted, the holes 450 are positioned generally central and defined by the sidewalls 454 of the orifice holder 246. However, it is also contemplated that any portion of the body 250 may define the holes 450.

Adjacent the inner wall portions 254, a first and a second pillar 482,486 are defined by the body 250 and may at least partially encase the stem when the stem 30 is received by the orifice holder 246. The first and second pillars 482,486 are proximate to the inner wall portions and define a gap therebetween. In addition, the first and second pillars 482, 486 may be tapered to match the construction of the inner wall portions 254 and compliment the stem. The first and second pillars 482,486 may also define grooves 478 similar to those defined by the inner wall portions 254 to receive projections, substantially similar to the projections shown in FIG. 6, outwardly extending from the stem. This configuration of the projections in the grooves 478 may help to secure the spreader within the orifice holder 246. It is generally contemplated that the number and positioning of the grooves 478 may vary depending on the size and configuration of the orifice holder 246. Accordingly, the configuration of the inner wall portions 254 and the first and second pillars 482,486 may increase the versatility of the orifice holder 246 and may provide increased stability such that a common orifice holder 246 may be used across the variety of spreaders. In addition, the first and second pillars 482,486 can be incorporated into other orifice holders of the type described herein, including the orifice holder 46 shown in FIGS. 1-10.

The invention disclosed herein is further summarized in the following paragraphs and is further characterized by combinations of any and all of the various aspects described therein.

According to one aspect of the present disclosure, a gas burner assembly for a cooktop includes a spreader that defines a top and an underside. The spreader includes a stem that extends from the underside to a depth and has a first diameter. The stem defines an opening to the top of the spreader. An orifice holder has a body that defines inner wall portions and receives a portion of the stem. A body defines at least one cup outwardly extending from the inner wall portions. The at least one cup is in fluid communication with the opening in the stem between the inner wall portions.

At least one cup can be a cavity defined by an extruded profile. The extruded profile can include a linear portion and a curved portion that can extend from an end and a side of each of the inner wall portions.

A stem can be tapered from a second diameter that can be adjacent to the underside to an end of the stem. The stem can define a depth. A first diameter of the stem can have a narrow width relative to the second diameter of the stem.

At least one cup can include a first cup and a second cup. An open upper portion of the orifice holder can be in fluid communication with a first cup and a second cup.

A first cup and a second cup can include a first lobe and a second lobe. The first lobe and the second lobe can be in fluid communication between an open upper portion of the orifice holder and the opening of the stem.

A first cup and a second cup can include a peripheral rim that can define an indentation in the first cup and the second cup. The indentation can separate the first lobe and the second lobe.

At least one cup can include a single cup surrounding inner wall portions.

According to another aspect of the present disclosure, a cooktop includes a surface and a spreader. The spreader defines a top and an underside. A stem extends away from the underside and defines an opening. An orifice holder includes a body that defines inner wall portions, a first cup and a second cup. The first cup and the second cup extend outwardly from the inner wall portions. An airflow path to the first and second cups defines between the surface and the underside of the spreader.

A first cup and a second cup includes a first lobe and a second lobe. The airflow path is defined through an open upper portion of an orifice holder and through the first lobe and the second lobe.

A first cup and a second cup can include a peripheral rim. The peripheral rim can define an indentation that can separate a first lobe and a second lobe.

Sidewalls of a body can include holes that can define an airflow path.

A body can define a first pillar and a second pillar. The first pillar and the second pillar can be proximate inner wall portions and can define a gap therebetween.

Inner wall portions can be tapered and can be configured to maintain a distance between an underside of a spreader and a surface.

A first cup and a second cup can define holes that can be configured to draw an airflow path into a body of an orifice holder.

According to yet another aspect of the present disclosure, an orifice holder includes a body that defines an inner chamber and inner wall portions, each having a first width relative to an upper portion of the body. A first cup extends outwardly from the inner wall portions. A second cup extends outwardly from the inner wall portions and interconnects with the first cup through the inner wall portions. An airflow path is defined to the inner chamber from the first and second cups.

A peripheral rim at an upper portion of an orifice holder can define an indentation of a first cup and a second cup. The indentation can separate a first lobe and a second lobe of the first cup and the second cup.

A first lobe and a second lobe can define an airflow path within a first cup and a second cup.

A first cup and a second cup can define an oblong shape and may be configured to direct an airflow path within a body.

A second width of inner wall portions can define a lower portion of a body and can be narrower than a first width of the inner wall portions located relative to an upper portion of the body.

A first cup and a second cup can be cavities defined by extruded profiles including a linear portion and a curved portion. The linear portion can extend outward from an end of inner wall portions. The curved portion can extend outward from a side of the inner wall portions.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A gas burner assembly for a cooktop, comprising:

a spreader defining a top and an underside and including a stem extending from the underside to a depth and having a first diameter, wherein the stem defines an opening to the top of the spreader; and an orifice holder having a body defining central inner wall portions receiving a portion of the stem, the body further defining at least one inner chamber and at least one cup outwardly extending from the inner wall portions around the at least one inner chamber and in fluid communication with the opening in the stem between the inner wall portions to define an airflow path directed into the at least one inner chamber of the body from an open upper portion of the body, and wherein the at least one cup facilitates direction of the airflow path.

2. The gas burner assembly of claim 1, wherein:

the at least one cup is a cavity defined by an extruded profile; and the extruded profile includes a linear portion and a curved portion extending from an end and a side of each of the inner wall portions, respectively.

3. The gas burner assembly of claim 1, wherein the stem is tapered from a second diameter adjacent to the underside to an end of the stem defining the depth, the first diameter of the stem being defined on the end having a narrow width relative to the second diameter.

4. The gas burner assembly of claim 1, wherein the at least one cup includes a first cup and a second cup, and wherein the open upper portion of the orifice holder is in fluid communication with each of the first and second cups.

5. The gas burner assembly of claim 4, wherein the first and second cups each include a first lobe and a second lobe, wherein the first and second lobes are in fluid communication between the open upper portion of the orifice holder and the opening of the stem.

6. The gas burner assembly of claim 5, wherein each of the first and second cups includes a peripheral rim defining an indentation, the indentation of each of the first and second cups separating the first lobe and the second lobe.

7. The gas burner assembly of claim 1, wherein the at least one cup includes a single cup surrounding the inner wall portions.

8. A cooktop, comprising:

a surface;

a spreader defining a top and an underside, wherein a singular stem extends away from the underside and defines an opening therethrough; and an orifice holder including a body defining inner wall portions configured to receive the singular stem, a first cup, and a second cup, the first and second cups each extending outwardly from the inner wall portions and each defining an inner chamber, wherein an airflow path to the stem through the first and second cups extends from between the surface and underside of the spreader and is directed through the inner chamber of each of the first and second cups.

9. The cooktop of claim 8, wherein:

the first and second cups each include a first lobe and a second lobe; and the airflow path is further defined through an open upper portion of the orifice holder and through each of the first and second lobes.

10. The cooktop of claim 9, wherein each of the first and second cups include a peripheral rim defining an indentation that separates each of the first and second lobes.

11. The cooktop of claim 8, wherein sidewalls of the body include holes that further define the airflow path.

12. The cooktop of claim 8, wherein the body further defines a first pillar and a second pillar proximate the inner wall portions and within a gap defined therebetween.

13. The cooktop of claim 8, wherein the inner wall portions are tapered and configured to maintain a distance between the underside of the spreader and the surface.

14. The cooktop of claim 8, wherein each of the first and second cups define holes configured to draw the airflow path into the body of the orifice holder.

15. An orifice holder, comprising:

a body defining an inner chamber and inner wall portions, each having a first width defined relative to an upper portion of the body;

a first cup extending outwardly from the inner wall portions; and a second cup extending outwardly from the inner wall portions and interconnected with the first cup through the inner wall portions, wherein an airflow path is defined to the inner chamber from the first and second cups toward a closed bottom of the body and is directed toward the inner wall portions and into the inner chamber by the first and second cups.

16. The orifice holder of claim 15, wherein a peripheral rim at an upper portion of the orifice holder defines an indentation of each of the first and second cups, and wherein the indentation separates a first lobe and a second lobe of each of the first and second cups.

17. The orifice holder of claim 16, wherein the first and second lobes further define the airflow path within the first and second cups.

18. The orifice holder of claim 15, wherein each of the first and second cups each define an oblong shape configured to direct the airflow path within the body.

19. The orifice holder of claim 15, wherein a second width of the inner wall portions is defined relative to a lower portion of the body and is narrower than the first width of the inner wall portions located relative to an upper portion of the body.

20. The orifice holder of claim 15, wherein the first and second cups are each cavities defined by respective extruded profiles that include a linear portion and a curved portion, the linear portion extending outward from an end of each of the inner wall portions, and the curved portion extending outward from a side of each of the inner wall portions.

* * * * *